United States Patent [19]

Natrasevschi

[11] Patent Number: 4,602,542

[45] Date of Patent: Jul. 29, 1986

[54] AUTOMATIC HAIR CUTTING APPARATUS

[76] Inventor: Alfred Natrasevschi, 3608 Jaguar Rd., Fort Collins, Colo. 80525

[21] Appl. No.: 593,644

[22] Filed: Mar. 26, 1984

[51] Int. Cl.[4] ..... B26D 5/30

[52] U.S. Cl. ..... 83/71; 30/133; 30/202; 132/45 R

[58] Field of Search ..... 30/201, 202, 133; 132/45 R, 9; 83/71, 174; 901/4, 5, 50; 128/76 R; 5/440; 297/392, 391

[56] References Cited

U.S. PATENT DOCUMENTS

| | | | |
|---|---|---|---|
| 1,238,061 | 8/1917 | Bourdelat | 30/133 |
| 3,413,985 | 12/1968 | Dlouhy et al. | 30/133 X |
| 3,828,377 | 8/1974 | Fary | 128/76 R X |
| 4,133,235 | 1/1979 | Gerber | 83/174 X |
| 4,235,472 | 11/1980 | Sparks et al. | 297/392 |
| 4,314,405 | 2/1982 | Park | 30/133 |

*Primary Examiner*—Douglas D. Watts

[57] ABSTRACT

An automatic hair cutting apparatus comprises a hair cutter, hair cutter control mechanism for adjusting the cut length, a frame for holding the human head in a specific fixed position, a robot arm coupled to the hair cutter and to the frame for positioning the hair cutter at specific positions on the human head, and a computer coupled to the cutter control mechanism and to the robot arm for controlling the hair cutter position and length according to a desired haircut style. The hair cutter comprises a vacuum source, a cutter tube with one end opening coupled to the vacuum source and another end opening having powered blades that do not obstruct the air flow and impart cutting action to the entire cross section of the cutter tube, a stretcher tube that can slide over the cutter tube for changing the length of the cut, a stepper motor with threaded shaft connected to the cutter tube and the stretcher tube for adjusting the length of the cut.

The frame comprises a first member with a notch at one end positioned to fit over the nose bridge of the human head, a second member positioned to touch the front of the chin, a third and fourth members positioned to touch the sides of the jaws, and a fifth member positioned to touch the underside of the chin.

2 Claims, 8 Drawing Figures

AUTOMATIC HAIR CUTTING APPARATUS

FIELD OF THE INVENTION

This invention relates to hair cutters and specifically to an automatic hair cutting apparatus that incorporates a hair cutter that can also be used manually.

DISCUSSION OF THE PRIOR ART

The presently used hair cutters rely on manual measuring of the cut length and for the most part rely on manual clipping of the hair ends. This is apparent from the currently used 'hands and scissors' technique in barber shops and from U.S. Pat. Nos. 2,661,529, 2,722,739, 3,557,449.

The disadvantages of manual hair cutting are:

time consuming and implicitly costly;

inconsistent quality.

There are some proposals that depart from the manual approach.

An example of such a patent is U.S. Pat. No. 4,030,196. This proposal however has the following disadvantages:

- the main function of a hair cutter is to cut hair; this proposal relies on the hair to be cut at the impact with a fixed blade due to air turbulence; in fact the air stream is deflected by the blade thus carrying the hair away from the cutting edge;
- even if some hairs would be cut, the proposal does not ensure that all the hairs that entered the casing will be cut; this leads to having an uneven hair cut.

To the best of my knowledge, there is no prior art regarding automatic computer controlled hair cutting.

SUMMARY OF THE INVENTION

According to the primary aspect of the present invention, an automatic hair cutting apparatus comprises a hair cutter, hair cutter control means coupled to the hair cutter for adjusting the cut length, a frame for holding the human head in a specific fixed position, a robot arm coupled to the hair cutter and the frame for positioning the hair cutter at specific positions on the human head, and a computer coupled to the cutter control means and to the robot arm for controlling the hair cutter position on the human head and the hair cutter length according to a desired haircut style. The computer controlls the movement of the hair cutter by the robot arm. The end of the hair cutter always touches the human head and moves along the human head surface until the whole surface with hair has been traversed at least once. This way the hair at each position on the head surface is cut at the predefined length as stored in the computer memory. The software program used to run in the computer is standard robot arm control software that is sold with robot arms. It includes a program that allows the operator to store in a program file the data for a haircut by adjusting interactively the hair cutter position and length from the computer keyboard and allowing the program to record the desired conditions. This automatic haircutting apparatus obviates the disadvantages of the manual hair cutting and ensures haircuts that are faster, less expensive, accurately repeatable and easy to design.

According to one of the principal aspects of this invention, the hair cutter comprises a vacuum source, a cutter tube with a first opening coupled to the vacuum source and a second opening having powered blades, a stretcher tube that can slide over the cutter tube for changing the length of the cut, a stepper motor with threaded shaft connected to the cutter tube and the stretcher tube for adjusting the length of the cut. The powered blades comprise a motor with gear box connected to the cutter tube such that it does not obstruct the air flow, a fixed blade having cutting edges extending from the center of the cutter tube to it's periphery and having a minimum number of thin arms to avoid obstructing the air flow and is coupled to the end of the cutter tube, a movable blade of similar design, coupled to the gear box shaft and frictionally coupled with the fixed blade. This hair cutter obviates the disadvantages of the prior art in that:

- all hairs that enter the hair cutter are cut, thus making unnecessary several passes over the same area.

This ensures a faster and more even haircut.

- there are essentially no obstructions in the path of the air flow, thus allowing better suction and lightweight, easy to handle construction.
- the minimum hair length is essentially equal with the thikness of the fixed blade, or under ¼ inch, as there are no parts between the blades and the hair. The maximum hair length is wirtually unlimited since a stretcher tube of any length can be attached. This leaves all the hairstyling options available, as opposed to limiting the possible haircuts to over 1 inch length as in some prior art.
- the blades are of a construction that lends itself to easy, inexpensive production and long, reliable operation.
- the blades are powered trough a simple mechanism that lends itself to inexpensive production and long, reliable operation.
- the use of a motor with gear box gives high torque and ensures the cutting of any amount of hair that enters the hair cutter, also it gives low speed of revolution which ensures low friction wear and thus long lasting blades.

The frame comprises a first member with a notch at one end positioned to fit over the nose bridge of the human head, a second member positioned to touch the front of the chin, a third and a fourth members positioned to touch the sides of the jaws, and a fifth member positioned to touch the underside of the chin. This frame obviates the disadvantages of the prior art in that:

- it provides a system of support members that will position any human head in a fixed and accurately repeatable position, for accurately repeating the same haircut; while the subject is holding the head against the support members, the head can not pivot or shift in any way relative to the frame.
- the support members of the frame are positioned against unchangeable bone structures of the head, thus ensuring consistent and repeatable positioning.
- it provides voluntary positioning by the subject, as oposed to any system involving confining holds.
- the position of the head is upright, afording personal confort for the subject and good access to the head for the haircutter.
- this frame allows rapid disengagement by the subject in case of emergency or discomfort by simply pulling the head back.

Further advantages of my invention will become apparent from a consideration of the drawings and the following description.

BRIEF DESCRIPTION OF THE DRAWINGS

FIG. 1 is a schematic representation of the automatic hair cutting apparatus.

FIG. 2 is a schematic, top view of the frame for positioning the scalp of the head that is represented in front view in FIG. 1.

FIG. 3 is a schematic, lateral view of the frame for positioning the scalp of the head.

FIG. 4 is a schematic, partially sectioned, front view of a preferred embodiment of the hair cutter described in my invention.

FIG. 5 is a schematic, partially sectioned, right view of the hair cutter in FIG. 4.

FIG. 6 is a schematic, partially sectioned, left view of the hair cutter in FIG. 4.

FIG. 7 is a schematic, top view of the hair cutter in FIG. 4.

FIG. 8 is a schematic, bottom view of the hair cutter in FIG. 4.

DESCRIPTION OF THE PREFERRED EMBODIMENT

Figure 1:
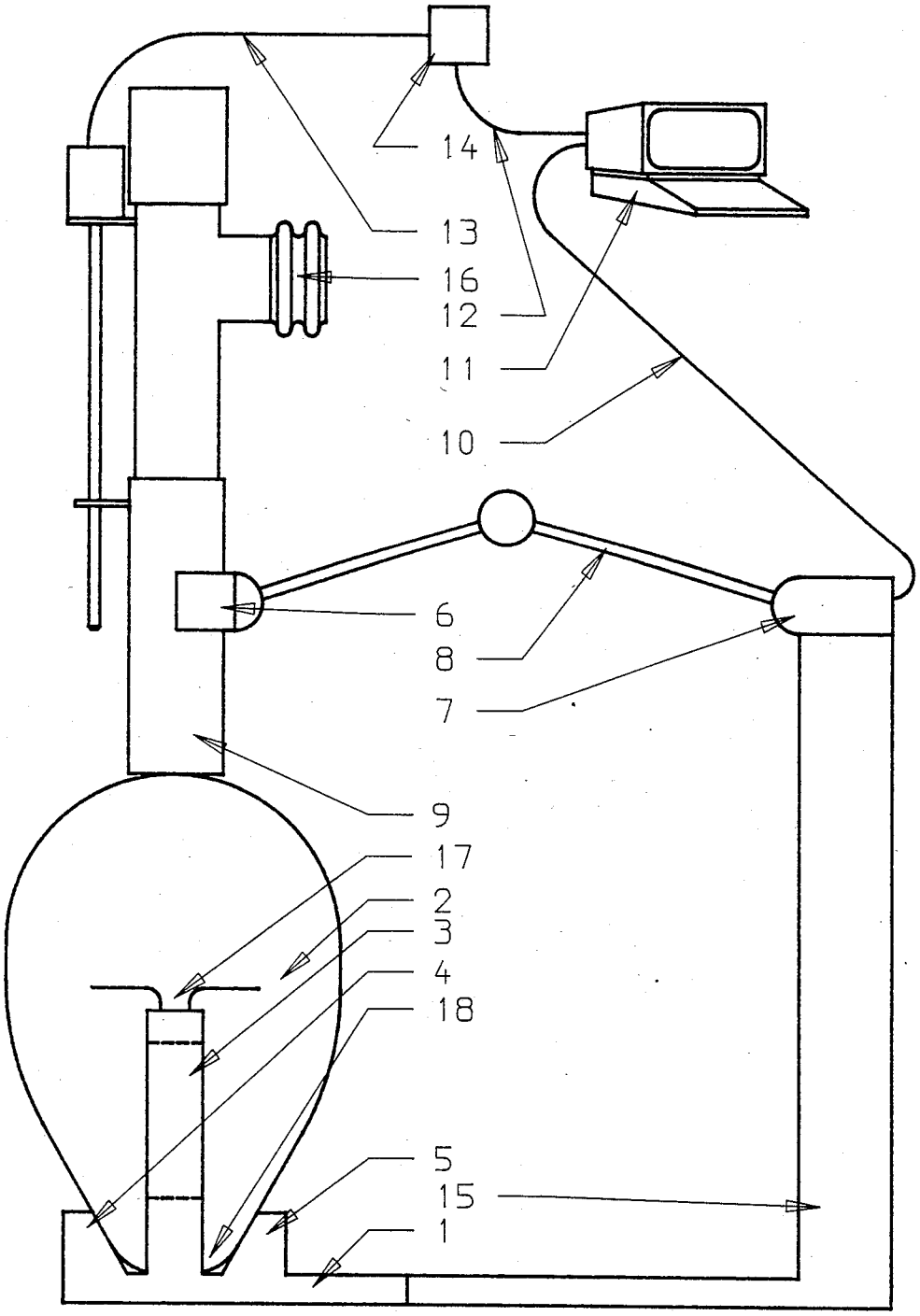
FIGS. 1, 2, 3, 4, 5, 6, 7, 8 refer to a preferred embodiment of my invention.

The automatic hair cutting apparatus shown in FIG. 1 consists of:

the apparatus chassis 15;

a frame 1 as a means for positioning the scalp of the head 2 in a known and repeatable position; the frame 1 is fixedly attached to the chassis 15;

a computer controlled robot arm as a means for positioning and moving the hair cutter; the robot arm comprises the gripper 6, the six joint arm 8 and the controller 7; the robot arm is fixedly attached to the chassis 15; examples of such robot arms available commercially are:

RHINO XR MARK II which is sold alone or together with it's controlling computer APPLE IIe; it is manufactured by Rhino Robots Inc., Champaign, Ill.

The robot arm is sold with a RS232 interface cable 10 for connecting to the computer 11 and with a software package. The software package includes a "Teach" program which allows the operator to position the robot arm in any position from the computer keyboard and then command the computer to store the coordinates of that position. The "Teach" program allows building trajectories from discrete positions. Once a fammily of trajectories is generated, it can be stored in any of the computer storage devices such as hard disk, floppy disk or tape and retrieved when necessary. Other programs in the software package will use the retrieved trajectories for moving the robot arm accordingly.

TEACHMOVER by MICROBOT which can operate through the standard interface RS232 with most computers; it is manufactured by MICROBOT Inc., Mountain View, Calif. This robot arm is sold with essentially the same accessories and software as described in the previous example.

a computer 11 such as Apple IIe.

a standard RS232 interface cable 10 between the robot arm and the computer 11;

a hair cutter 9 which also comprises means for changing the length of the cut under computer control as specified within the hair cutter description;

hair cutter control means comprising:

an interface cable 13 between the means for changing the hair cut length and the interfacing module 14; in this embodiment the means for changing the cut length are driven by a stepper motor;

an interface module 14 for controlling stepper motors by computer; examples of such modules are:

SMART STEPPER manufactured by CENTRE COMPUTER CONSULTANTS, STATE COLLEGE, PA; This stepper motor controller is sold with a cable 13 for connecting to the computer and a cable 14 for connecting to the controlled stepper motor. This controller is the equivalent of any of the one joint controllers on the robot arm (the robot arm has 6 separately controlled joints). Therefore the software package described for the robot arm will controll the stepper motor as just another controlled joint. This includes teaching specific lengths in corelation with specific robot arm positions using the "Teach" program, storing and retrieving as described under the robot arm example.

Figure 2:
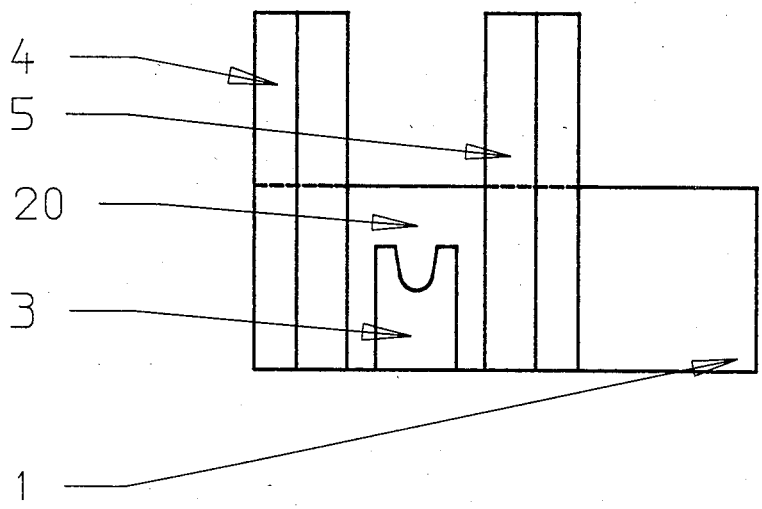
Figure 3:
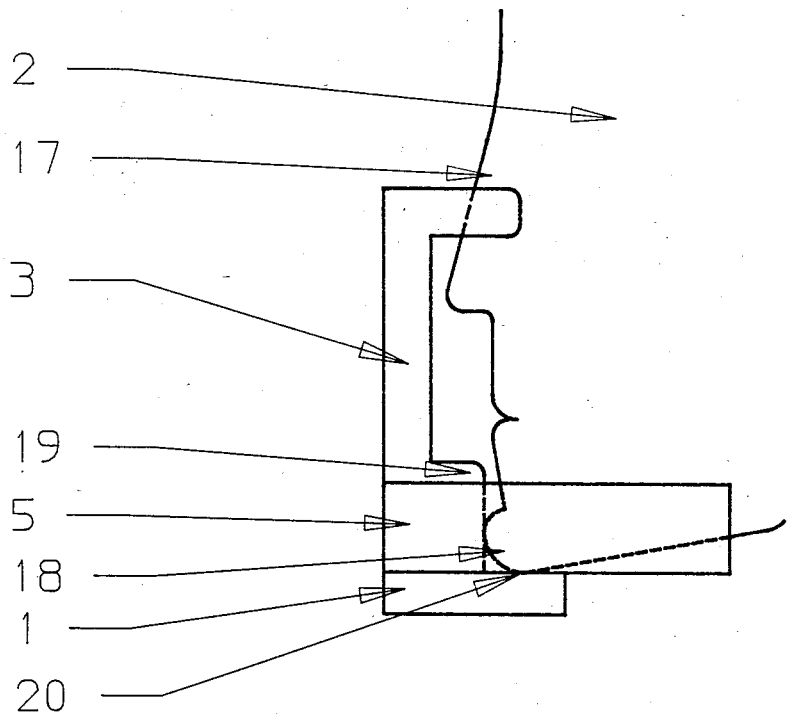
Figure 4:
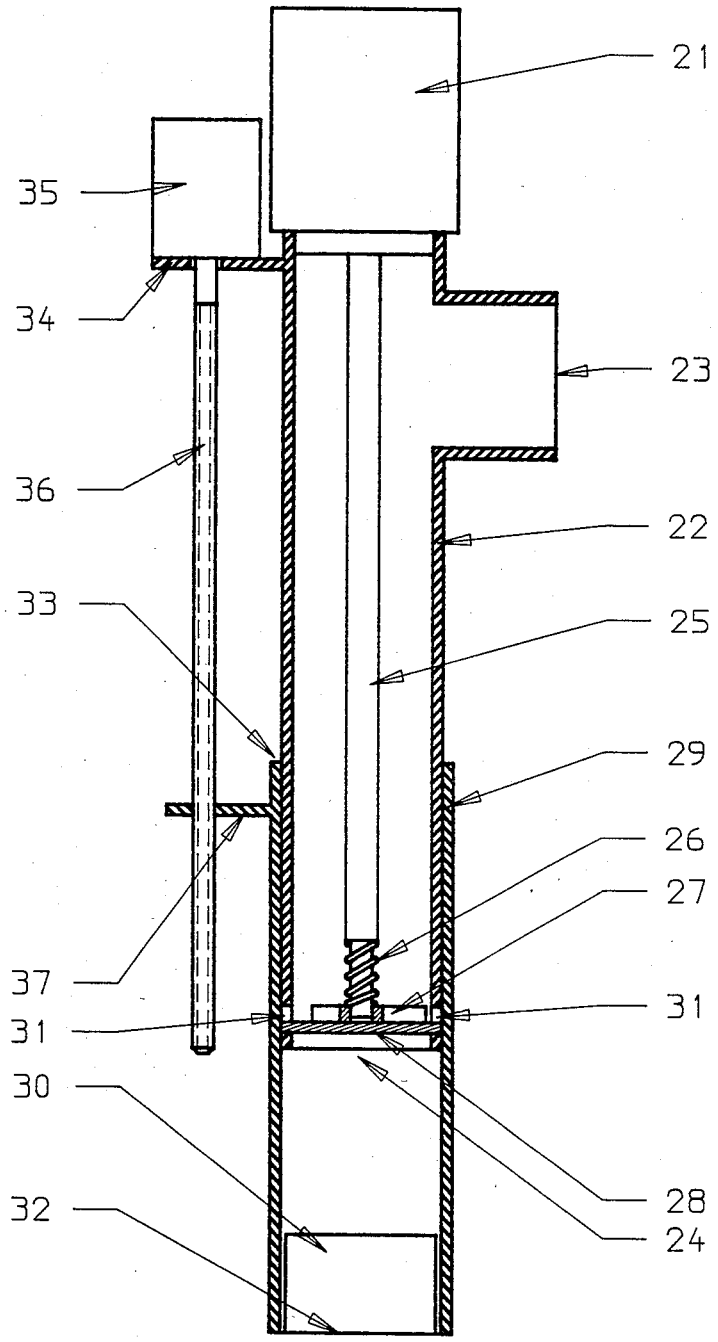
Figure 5:
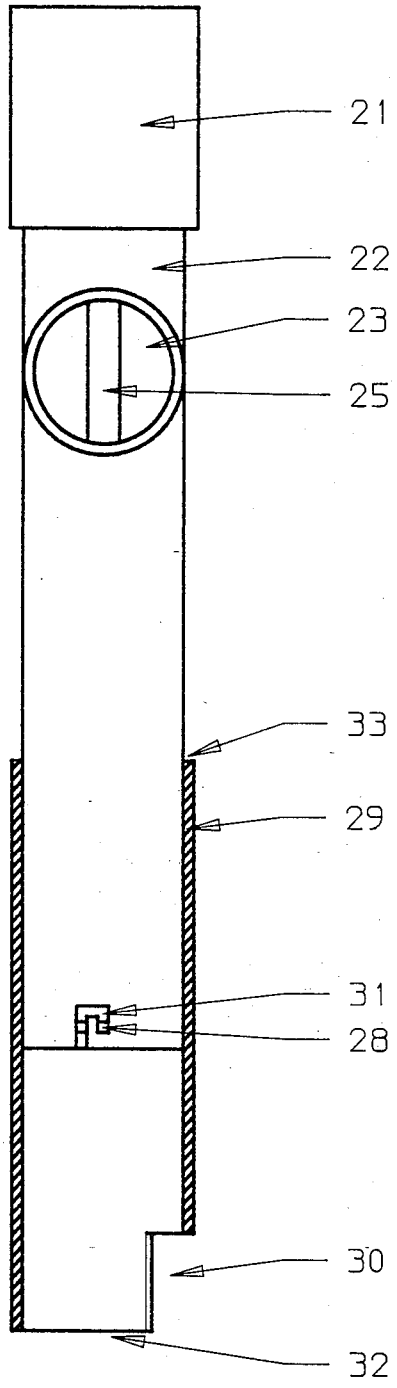
Figure 6:
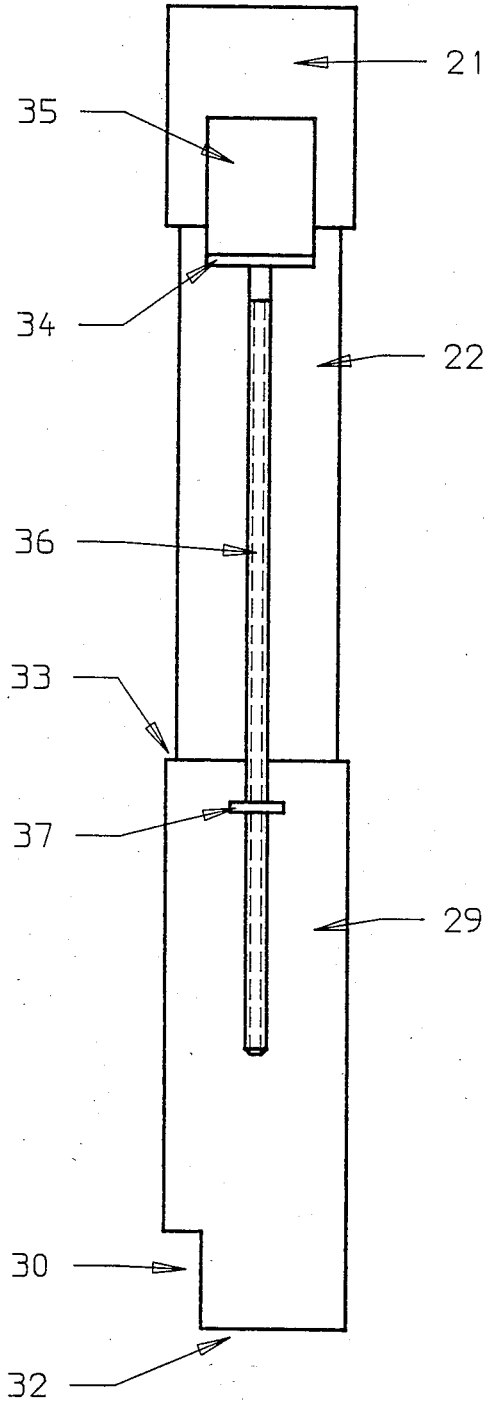
Figure 7:
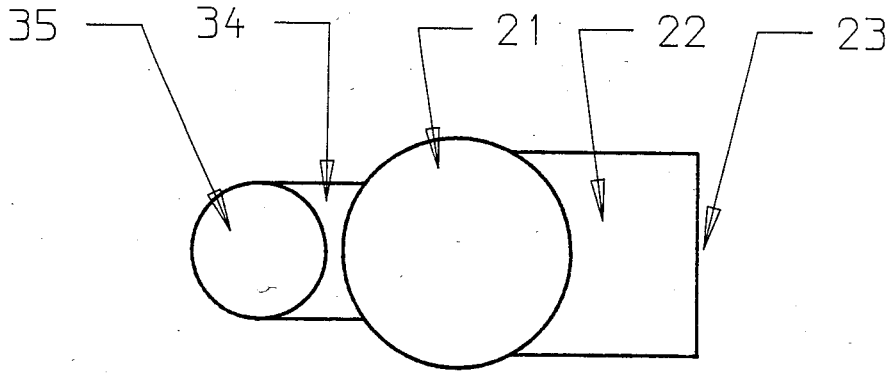
Figure 8:
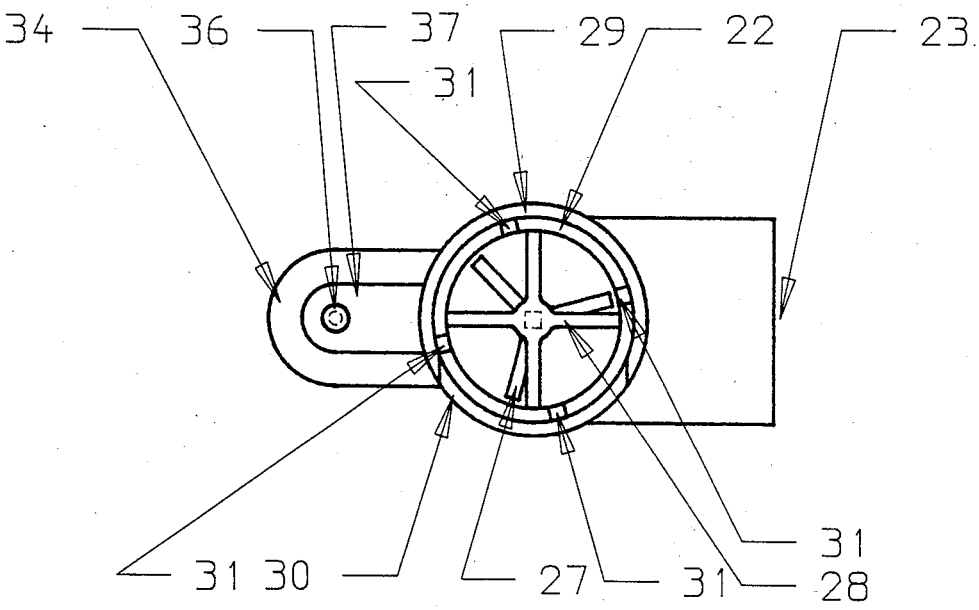

5005-DB manufactured by AMSI CORP, SMITHTOWN, NY; a cable 12 for controlling the interface module 14 from the computer 11; for the SMART STEPPER a RS232 cable is used for interfacing with most computers;

in FIGS. 2 and 3 I have shown further views of the frame 1 represented in FIG. 1 as a means for positioning the scalp of the head. It comprises:

a rigid first member 3 that extends up to the nose bridge 17 which is schematically represented in FIGS. 1 and 3; the end of rigid first member 3 fits over the nose essentially as eyeglasses do;

a rigid second member 19 that makes contact with the chin 18 and prevents its forward motion;

the rigid third member and the rigid fourth member 4 and 5 for limiting the lateral movement of the head at the chin and jaw level;

a rigid fifth member 20 which makes contact with the chin 18 and prevents it's downward motion as shown in FIG. 3.

In FIGS. 4, 5, 6, 7, 8 I have shown a hair cutter that can be used manually or incorporated in the automatic hair cutting apparatus as the subassembly 9 in FIG. 1.

Its description is as follows:

The cutter tube 22 has a first opening 24 that communicates with a second opening 23. The first opening 24 sucks in the hair ends when the second opening 23 is connected to a vacuum source such as a vacuum cleaner.

At the first opening 24 of the cutter tube 22 the fixed blade 28 is fixedly attached by inserting it in the notches 31. As can be best seen in FIG. 5, the fixed blade 28 is inserted in the notches 31 by sliding the blade in the open end of the notches, following the trajectory of the notches and leaving the blade pressed toward the dead end of the notches.

The movable blade 27 is attached to the shaft 25 such that it can slide on the shaft in the direction of shaft's axis but it will rotate when the shaft rotates. This is achieved by having the end of the shaft 25 and the hole in the blade 27 rectangular in cross section. Thus the motor 21 drives the blade 27 via the shaft 25.

The motor 21 may or may not incorporate gears to reduce the speed of its shaft for minimizing blade wear.

The movable blade 27 is pressed against the fixed blade 28 by the spring 26. The blades 27 and 28 are implemented such that they offer a minimal obstruction to the air flow. The cutting edges are provided by the radial arms of the blades; these arms need to be as thin as possible without compromising the arm rigidity, for allowing air circulation. The arms of the blades are partitioning the cross section of the tube such that the hair strand is separated in several substrands for easier cutting.

The fixed blade 28 has four arms while the movable blade 27 has three arms in order to distribute the cutting effort; this way the cutting is done by one pair of edges at a time as opposed to cutting the whole strand at once. This way blockage of the cutter by thick strands of hair is avoided and a smoother operation is achieved.

At the first opening 24 of the cutter tube 22 the stretcher tube 29 is attached. In one embodiment the friction between the cutter tube 22 and the stretcher tube 29 is such that they are fixedly attached; this does provide for a low cost hair cutter where the cut length is changed by changing to a stretcher tube 29 of another length. In another embodiment the friction between the stretcher tube 29 and the cutter tube 22 is such that they are slidably attached; this allows easy change of the length of the hair cut wether the change is done manually or automatically.

Next to the first end opening 32 of the stretcher tube 29 there is a lateral opening 30 for suction of the hair when the end opening 32 comes in contact with the scalp and hair.

The second end opening 33 of the stretcher tube 29 is affixed to the cutter tube 22 such that the hair ends are directed into the cutter tube 22.

On the protrusion 34 of the cutter tube 22 is fixedly attached the motor 35 which drives the threaded shaft 36. The shaft 36 passes through a threaded hole in the protrusion 37 of the stretcher tube 29. Thus the motor 35 may change the relative positioning of the cutter tube 22 and stretcher tube 29 in order to set the desired hair cut length.

Any embodiment of the automatic hair cutting apparatus deals with combining together all the means necessary for automatic execution of a hair cut.

The detailed operation of this embodiment of the automatic hair cutting apparatus as represented in FIG. 1 is as follows:

The head 2 of the person that is to receive the hair cut is positioned in the frame 1. The person holds voluntarily the head 2 pressed against the reference surfaces of the frame 1 for positioning the scalp of the head 2 and thus ensures that the scalp will be positioned every time in accurately the same position versus the chassis 15. The scalp position versus the chassis will be different from one individual to another according to anatomic differences. However each scalp will have a known and repeatable position versus the frame 1 and implicitly versus the chassis 15 and the robot arm reference coordinates.

The robot arm holds with its gripper 6 the hair cutter 9.

The robot arm is controlled through its controller 7 by a computer 11 such that the position and the trajectory of the hair cutter 9 versus the frame 1 is always known and controlled by the computer.

The hair cutter 9 comprises means for cutting the hair at a given length and means for changing that length under the control of the computer 11; in this embodiment of the apparatus I used the hair cutter described in this invention because it is the only hair cutter to my knowledge that comprises the necessary means.

The robot arm interfaces with the computer 11 through the cable 10. This is a RS232 cable for most commercial models of robot arms and computers.

The cut length changing device incorporated in the hair cutter 9 receives commands from the computer 11 via the cable 12, the module 14 and the cable 13.

The hair cutter 9 is connected to a vacuum source through the flexible hose 16. The motor that drives the hair cutter blades is powered at all times.

When operating, the computer 11 retrieves from its memory stored information that characterizes the hair cutter movements necessary for scanning a certain individual scalp; the computer also retrieves stored information that associates a certain hair cut length to each position on the scalp.

The computer 11 then transforms this information in control signals for the robot arm positions and the hair cutter 9 cut length setting. Consequently the hair cutter 9 is moved by the robot arm such that it cuts the hair at the specified length and at the specified position on the scalp of the head 2. This continues until all positions on the scalp have been exhausted and the hair cut has been thus completed.

Various robotics companies offer computer software packages that are designed to handle positioning and trajectory movement as described above. These software packages contain tools such as a learning mode that can be used for learning and storing the positions, trajectories and hair lengths necessary for an individual scalp and its hair cut.

Examples of such software packages are the software that come with the two robot arms mentioned above.

The learning mode of the robot arm is an efficient and versatile tool for designing the hair cut. For example: it sufficies to input in the robot two positions with different cut lengths and the robot will interpolate in order to provide the trajectory between the two points and the associated tapering in the hair length. Therefore the algorithm for designing a hair cut requires to teach the robot only key positions on the scalp and their associated hair lengths. The key positions to teach the robot are the positions that delimit the scalp borders, the positions on the scalp where standard robot trajectory types meet (such as straight lines or circle sectors) and the positions on the scalp where the hair length tapering rate needs to change.

The detailed operation of the preferred embodiment of the frame for positioning the scalp of the head as represented in FIGS. 1, 2 and 3 is as follows:

The head 2 is positioned in the frame 1 such that the sides of the jaws rest on the sloped surfaces of the rigid third member 4 and rigid fourth member 5; the slope ensures that both the lateral and downward motion of the jaws is prevented. Next the head is pushed forward until the rigid second member 19 stops the forward motion of the chin 18. The chin 18 also rests on the rigid fifth member 20 of the frame 1. The nose bridge 17 fits in the slot at the end of the rigid first member 3.

While the person holds voluntarily the head against the described reference points of the frame 1, the head is essentially in a fixed position. This fixed position is referenced against essentially unchangeable bone structures of the head. Therefore the head can be placed in the same position for subsequent hair cuts.

This structure of the frame 1 allows easy voluntary positioning of the head as well as fast removal in case of emergency.

Any embodiment of the hair cutter stretches the hair strand in a stretcher tube by using rapid air flow, establishes the desired cut length by sliding the cutter tube versus the stretcher tube and cuts the hair ends with a blade system affixed at the front opening of the cutter tube and powered by a motor; hair clips are disposed of into the vacuum source that generates the rapid air flow; an embodiment of this invention may involve manual positioning of the hair cutter or automatic positioning under computer control.

The detailed operation of the preferred embodiment as represented in FIGS. 4, 5, 6, 7 and 8 is as follows:

The hair cutter is placed with the axis of the tubes 22 and 29 in the general direction of perpendicular on the scalp surface. The lateral opening 30 has a cross section equal to the cross section of the stretcher tube 29 and it provides the air intake. Thus the air circulates between the openings 30 and 23 via the tubes 22 and 29. Aside from the openings 23 and 30 the tubes 22 and 29 are essentially air tight; the end opening 32 of the stretcher tube 29 is obstructed by the scalp surface.

The strand of hair that will be cut is composed of the hair delimited by the first end opening 32 and the hair sucked in by the lateral opening 30 from the area in front of it. This strand of hair is stretched inside the stretcher tube 29 due to the air motion. The cutter tube 22 is positioned versus the stretcher tube 29 such that the distance between the first end opening 32 of the stretcher tube and the contact surface of blades 27 and 28 is equal to the desired hair length. In one embodiment the sliding joint between the tubes 22 and 29 has enough friction for the tubes to be fixedly attached and the cut length is changed by replacing the stretcher tube 29 with a stretcher tube of another length; in another embodiment the sliding joint between the tubes 22 and 29 has enough friction for the sliding to occur only when manually induced; in yet another embodiment the elements 34, 35, 36 and 37 are provided and the sliding occurs when the motor 35 drives the threaded shaft 36 and causes the threaded protrusion 37 to move along the shaft 36.

The hair ends are now passing from the stretcher tube 29 and through the blades 27 and 28 into the cutter tube 22. The motor 21 rotates the blade 27 via the shaft 25. The spring 26 applies a force between the shaft 25 and the blade 27 which results in pressure between the blades 27 and 28. The rotation of blade 27 by the motor 21 and the pressure between the blades 27 and 28 will cause the cutting of the hair ends. The ratio between the number of cutting arms of the blades 27 and 28 respectively is such (for example $\frac{3}{8}$) as to distribute in time the effort of the motor as opposed to having all the hairs in the strand cut simultaneously. The cutting edge of the blades scans the whole cross section of the cutter tube 22 in order to ensure that all the hair ends that enter the cutter tube 22 will be cut.

The air flow propels the hair clips through the cutter tube 22 and through the second opening 23 into the vacuum source. The vacuum can be provided by a regular vacuum cleaner or by another vacuum source that is equipped to properly dispose of the hair ends.

While the above description contains many specificities, these should not be construed as limitations of the scope of the invention but rather as an exemplification of one preferred embodiment.

I claim:

1. A hair cutting apparatus for automatic cutting of the hair on a human head, comprising:

a hair cutter means for cutting a selected plurality of strands of hair on a human head;

hair cutter control means coupled to the said hair cutter means for adjusting the length to which each said plurality of strands of hair is cut;

frame means for holding the said human head in a specific fixed position;

robot arm means coupled to said hair cutter means and said frame means for positioning the said hair cutter means at specific positions on the scalp of the said human head;

and computer controll means coupled to said hair cutter controll means and said robot arm means for controlling the operation of the said hair cutter means in accordance with a particular desired haircut style.

2. An adjustable and vacuum assisted hair cutter for cutting hair at any specific length, comprising:

a vacuum source for providing rapid air flow;

a cutter tube having a first opening communicating essentially unobstructed with a second opening, said second opening being connected to the said vacuum source for suction of the said hair into said first opening and for disposal of the hair clippings;

a motor means comprising a motor and reduction gears, said motor means being connected to said cutter tube at a location out of said air flow, for providing power for the cutting action at low speed and high torque;

a cutting means comprising a fixed blade connected to said first opening of said cutter tube, said fixed blade having thin cutting arms which extend across the whole cross section of the said cutter tube, and a movable blade mounted on the shaft of the said motor means, said movable blade being frictionaly engaged with the surface of the said fixed blade opposite to the said first opening, said movable blade having thin cutting arms which extend across the whole said cross section, said movable blade having a number of cutting arms that is in an odd-even relationship with the number of cutting arms of the said fixed blade, for dividing the said hair into easy to cut thinner strands, for allowing the said airflow essentially unobstructed, for providing a safe nonmoving screen to the user, for imparting cutting action on any and all of the said hair that enters the said cutter tube, for distributing the cutting effort over the rotation cycle of the said movable blade, for reducing the peak load on the said motor means and for smoother cutting action;

a stretcher tube having a first opening communicating essentially unobstructed with a second opening, said second opening of the said stretcher tube being slidably connected to the said first opening of the said cutter tube in such a manner that the said cutter tube can slide inside the said stretcher tube, for changing the length of the said hair cut between as long as the said stretcher tube and as short as the thickness of the said fixed blade.

* * * * *